United States Patent [19]

Graff

[11] 4,265,950

[45] May 5, 1981

[54] PHOSPHOR-COATING COMPOSITION AND METHOD FOR ELECTRIC DISCHARGE LAMP

[75] Inventor: Eugene A. Graff, Cedar Grove, N.J.

[73] Assignee: Westinghouse Electric Corp., Pittsburgh, Pa.

[21] Appl. No.: 97,767

[22] Filed: Nov. 27, 1979

[51] Int. Cl.[3] ..... F21K 2/00

[52] U.S. Cl. ..... 428/35; 106/286.2; 106/286.6; 106/286.8; 106/287.17; 106/302; 252/301.4 F; 252/301.6 R; 427/67; 427/70; 427/106; 427/107; 427/109; 427/126.2; 427/126.3; 427/126.4; 428/323; 428/537

[58] Field of Search ..... 427/67, 70, 106, 107, 427/109, 126; 106/286.2, 286.6, 286.8, 287.17, 302; 252/301.4 F, 301.6 R; 428/323, 35, 537; 313/109

[56] References Cited

U.S. PATENT DOCUMENTS

| | | | |
|---|---|---|---|
| 2,905,572 | 9/1959 | Jones | 427/67 |
| 3,067,356 | 12/1962 | Ray | 313/221 |
| 3,377,494 | 4/1968 | Repsher | 313/109 |
| 3,424,605 | 1/1969 | Beaumont | 427/67 |
| 3,424,606 | 1/1969 | Giudici | 427/67 |
| 3,585,207 | 6/1971 | Repsher | 252/301.3 R |
| 3,809,944 | 5/1974 | Jongerius | 313/227 |
| 3,833,398 | 9/1974 | Schreuns | 252/301.45 |

FOREIGN PATENT DOCUMENTS 43-25213 10/1968 Japan .

*Primary Examiner*—Marion McCamish
*Attorney, Agent, or Firm*—D. S. Buleza

[57] ABSTRACT

Improved adhesion of the phosphor coating in a fluorescent lamp having a transparent film of conductive material (such as tin oxide) on the inner surface of the bulb is obtained by adding small but correlated amounts of finely-divided aluminum oxide, calcium nitrate, and ammonium nitrate to the water-base phosphor-coating composition. The combination of additives bonds the phosphor particles to the bulb despite the intervening layer of tin oxide and the lower lehring temperature required to preserve its conductivity. When the conductive film is composed of a material which can tolerate higher lehring temperatures, other additives such as barium nitrate, cadmium nitrate and strontium nitrate can be substituted for or admixed with the calcium nitrate. Alternatively, the ammonium nitrate additive can be eliminated by admixing selected quantities of calcium nitrate and barium nitrate (for example, a blend of 65 mole % calcium nitrate and 35 mole % barium nitrate) to form a "two-component" additive which melts at a lower temperature than either of the constituents in the blend. Two-component additives containing blends of properly correlated amounts of barium nitrate-strontium nitrate and calcium nitrate-strontium nitrate can also be employed.

14 Claims, 3 Drawing Figures

PHOSPHOR-COATING COMPOSITION AND METHOD FOR ELECTRIC DISCHARGE LAMP

BACKGROUND OF THE INVENTION

This invention generally relates to electric discharge lamps and has particular reference to an improved method and composition for phosphor-coating fluorescent lamps having envelopes which are precoated with a transparent film of conductive material to facilitate lamp starting.

Electric discharge lamps having tubular glass envelopes that are provided with an interior transparent film of various materials which serves as a protective-barrier for the phosphor coating or as a starting aid are generally well known in the art. U.S. Pat. No. 3,067,356 granted Dec. 4, 1962 to Ray, for example, discloses a fluorescent lamp wherein mercury-alkali reaction at the inner surface of the glass envelope is inhibited by a transparent layer of $Al_2O_3$, $SiO_2$, or $TiO_2$. The use of a transparent layer of titanium dioxide or zirconium dioxide which contains selected metal oxides as additives and forms a protective coating for a fluorescent lamp envelope is disclosed in U.S. Pat. No. 3,377,494 issued Apr. 9, 1968 to Repsher. An aperture-type fluorescent lamp wherein the portion of the glass envelope which defines the aperture is coated with a conducting transparent coating of tin oxide or indium oxide is described in U.S. Pat. No. 3,809,944 issued May 7, 1974 to Jongerius et al. A method of improving the adhesion of a reflecting coating of titanium oxide or aluminum oxide that is applied to the inner surface of a fluorescent lamp bulb which has previously been coated with a transparent electrically conductive coating is disclosed in Japanese Pat. No. 43-25213 of Kobajashi et al. granted Oct. 31, 1968. The method consists of adding nitrates and/or borates of zinc, calcium, cadmium, barium or magnesium in an aqueous solution to the reflector-forming material, together with some ammonia, and then drying the resulting reaction product before it is applied to the bulb.

Various techniques for improving the adherence of phosphor coatings to fluorescent lamp envelopes which do not have transparent coatings are also generally well known in the art. In U.S. Pat. No. 2,905,572 granted Sept. 22, 1959 to Jones, this objective is achieved by adding materials such as calcium nitrate and an ethyl borate solution to the phosphor paint, which materials decompose during the bulb lehring operation to form a $CaO:B_2O_3$ cementing material which bonds the phosphor particles to the untreated glass surface. Improved lamp phosphor adherence by adding from 0.05 to 0.3 weight percent (based on the phosphor content) barium nitrate to the phosphor-containing coating composition applied to conventional glass bulbs (no transparent film) is disclosed in U.S. Pat. No. 3,424,605 issued Jan. 28, 1969 to Beaumont et al. U.S. Pat. No. 3,424,606 to Giudici effects a further improvement in phosphor adherence by including from 0.1 to 2.5 weight percent ammonium nitrate, in combination with 0.05 to 0.3 weight percent barium nitrate, in an aqueous suspension of the phosphor and an organic binder that is applied to such conventional bulbs.

U.S. Pat. No. 3,585,207 issued June 15, 1971 to Repsher discloses a water-base phosphor-coating composition wherein improved adhesion of the lehred phosphor layer to a conventional lamp bulb (no film) is obtained by adding to the coating composition from 0.1 to 1.0 weight percent of aluminum oxide (in the form of an Alon-C material which consists of finely-divided aluminum oxide particles of a specified size range). U.S. Pat. No. 3,833,398 to Schreurs discloses another method of improving the adherence of the phosphor coating in a conventional type fluorescent lamp by pretreating the phosphor and aluminum oxide particles with a solution of ammonium lignosulfonate.

In order to reduce the starting voltage of fluorescent lamps which contain a mixed fill gas (such as krypton and neon) that decreases the wattage loading of the lamps, it has become the practice to coat the inner surface of the glass bulb of such lamps with a transparent film of conductive material before the phosphor coating is applied. The transparent film not only makes it very difficult to bond the phosphor particles to the bulb surface but requires that lower lehring temperatures be employed to prevent an undesirable decrease in the conductivity of the film. Such lower lehring temperatures (in the order of 580° C. versus the 650° C. or so generally used) further aggravates the phosphor-adherence problem. In an effort to solve this problem, the Alon-C additive to the phosphor coating composition has been increased (up to 1.5 weight %) but this results in a drop in the light output of the lamps.

It has been discovered that the poor adherence of the phosphor coating experienced in the production of fluorescent lamps having envelopes which are provided with such transparent conductive films (tin oxide, for example) can be prevented by employing selected and very precisely correlated amounts of aluminum oxide particles (Alon-C), in combination with ammonium nitrate and a third additive selected from the group consisting of calcium nitrate, barium nitrate, cadmium nitrate, strontium nitrate and mixtures thereof. These materials are added to the aqueous coating composition or "paint" which contains the phosphor particles, a suitable organic binder and small amounts of defoaming and wetting agents. By virtue of the manner in which the quantities of the various additives are correlated, such additives not only reduce the amount of aluminum oxide (Alon-C additive) heretofore employed in the phosphor paint but permit adherent phosphor coatings to be produced despite the lower lehring temperatures which are required to prevent undesirable decreases in the conductivity of the transparent film.

Improved phosphor adhesion and enhanced light output have been achieved in the case of tin-oxide coated fluorescent lamps by using only from about 0.1 to 0.6 weight percent of Alon-C in the aqueous phosphor-coating composition in combination with from about 0.05 to 0.25 weight percent calcium nitrate and from about 0.1 to 0.8 weight percent ammonium nitrate. Alternatively, preliminary tests have also indicated that satisfactory phosphor adhesion can be achieved in such lamps by omitting the ammonium nitrate additive and simply mixing selected amounts of two of the other nitrate additives (for example calcium nitrate and barium nitrate) which together form a dual-component "eutectic like" constituent that has a lower melting point than either of the components if used separately.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENTS

While the present invention can be advantageously employed in the manufacture of various types of electrical devices that have glass envelopes or substrates which are coated with luminescent materials, it is particularly adapted for use in conjunction with fluorescent lamps which operate at reduced wattage and thus require phosphor coatings that are deposited over transparent conductive films which have previously been deposited on the inner surface of the envelope and it has, accordingly, been so illustrated and will be so described.

Figure 1:
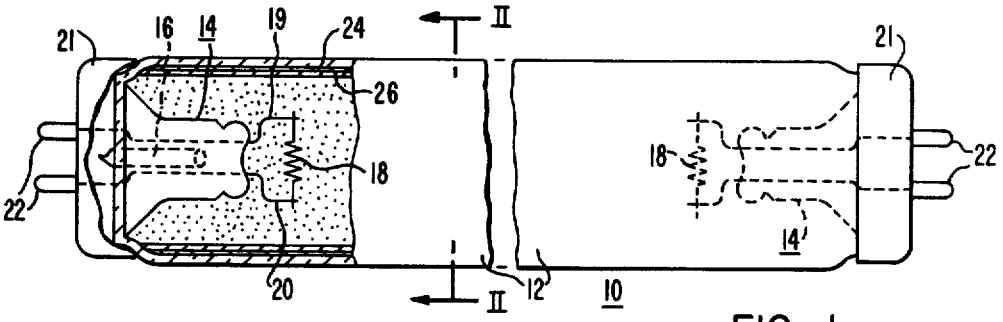
FIG. 1 is a side elevational view, partly in section, of a fluorescent lamp which has a transparent conductive film on the inner surface of the lamp envelope and has been coated with phosphor in accordance with the invention.

A fluorescent lamp 10 of the aforesaid type having a tubular vitreous envelope 12 that is sealed at each end by conventional glass stems 14 is shown in FIG. 1. In accordance with standard lamp-making practice, at least one of the stems is provided with a tubulation 16 through which the envelope 12 is evacuated and subsequently filled with a suitable starting gas (such as several torr of a krypton-neon mixture or the like) and dosed with mercury which coact to provide an ionizable medium within the sealed envelope that sustains a low-pressure electric discharge between the pair of electrodes 18 carried by the respective stems. The electrodes 18 are connected by lead wires 19, 20 to base members 21 that are secured to the associated sealed ends of the envelope 12 and carry suitable terminals such as metal pins 22. The krypton-neon fill gas reduces the wattage at which the lamp operates but also increases its starting voltage.

Figure 2:
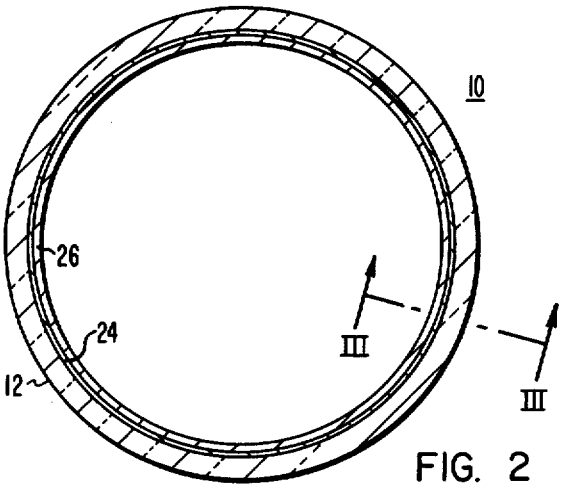
FIG. 2 is an enlarged cross-sectional view through the coated lamp envelope, along line II—II of FIG. 1.
Figure 3:
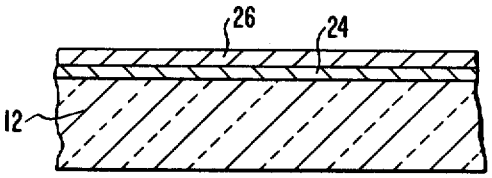
FIG. 3 is a cross-sectional view of a part of the envelope wall, along line III—III of FIG. 2, showing in even greater detail the relationship of the transparent-conductive film and the phosphor coating.

In order to reduce the starting voltage of the lamp 10, the inner surface of the tubular glass envelope 12 is coated with a thin transparent film 24 of a suitable conductive material such as tin oxide or indium oxide. A layer 26 of phosphor material is deposited over the transparent conductive film 24 and, as will be noted in FIGS. 2 and 3, such phosphor layer completely covers and is much thicker than the conductive film.

While the use of such conductive films provides reduced-wattage type fluorescent lamps that will reliably start on standard ballasts, they significantly reduce the adhesion of phosphor coatings that are applied to the envelopes in the form of conventional phosphor-paint systems. The conductive film not only acts as a "barrier" between the phosphor coating and the underlying surface of the glass envelope which prevents a strong bond between the phosphor particles and the envelope but, in the case of tin-oxide films, requires that the phosphor-coated lamp bulbs be lehred at lower temperatures than those used in making conventional type fluorescent lamps (600° C. and above). Such lower lehr temperatures (580° C. or so) are required insofar as the conductivity of the tin oxide coating decreases when the higher lehr temperatures are employed. To remedy this poor phosphor-adhesion problem additional amounts of aluminum oxide (commercially available under the trademark Alon-C) were heretofore employed in the phosphor-paint composition. From 1.0% to 1.5% $Al_2O_3$ (by weight of the phosphor content) was added to the phosphor coating composition for this purpose. However, these relatively large quantities of Alon-C produced an undesirable decrease in the lumen output of the finished lamps.

In accordance with the present invention, a phosphor coating composition and method have been provided which not only permits the envelopes of such reduced-wattage fluorescent lamps to be lehred at the lower lehring temperatures required to protect the tin oxide film but produces phosphor coatings that exhibit improved adhesion (even though a significantly smaller quantity of Alon-C is employed) and also enhances the light output of the finished lamps. The improved phosphor-paint composition contains a small amount of Alon-C ($A1_2O_3$ particles) in combination with very carefully correlated amounts of ammonium nitrate ($NH_4+NO_3$) and an additional additive selected from the group consisting of calcium nitrate ($Ca(NO_3)_2$), cadmium nitrate ($Cd(NO_3)_2$), strontium nitrate ($SrNO_3)_2$), barium nitrate ($Ba(NO_3)_2$), and mixtures thereof.

In the case of 40 watt fluorescent lamps having envelopes that are coated with a tin-oxide conductive film of transparent thickness, excellent results have been obtained by using a water-base phosphor-coating composition that contains a small amount of Alon-C and a mixture of correlated quantities of calcium nitrate and ammonium nitrate. Carefully controlled quantities of the three additives are employed with the permissible range for each of the additives being as follows: from about 0.1% to 0.6% by weight (based on the phosphor weight) finely-divided $Al_2O_3$ in the form of Alon-C, from about 0.05% to 0.25% by weight calcium nitrate, and from about 0.1% to 0.8% by weight ammonium nitrate. Optimum adhesion of the phosphor layer was obtained when the calcium nitrate content was in the range of from about 0.15% to 0.25% by weight and the lumen output of the lamps started to decrease when quantities of this additive in excess of about 0.25% were employed.

As indicated by the following test data (Table I) comparing the lumen outputs of various 40 watt type tin-oxide coated fluorescent lamps which are coated with phosphor-paint compositions that contained different amounts of the respective additives, the preferred phosphor-coating composition for such lamps contains about 0.4% by weight $Al_2O_3$, about 0.5% by weight ammonium nitrate, and from about 0.15% to 0.25% by weight calcium nitrate.

TABLE I

Light Output With Various Phosphor-Coating Compositions

| Additive(s) in Phosphor Paint(% By Wt.) | Lumens 0 Hr. | Lumens 100 Hr | 0–100 Hrs. Lumen Drop | 0–100 Hrs. % Maintenance |
|---|---|---|---|---|
| 0.0% Alon-C | 2763 | 2642 | 121 | 95.6 |
| 1.5% Alon-C | 2708 | 2536 | 172 | 93.6 |
| 1.0% Alon-C (Test #1) | 2686 | 2500 | 186 | 93.1 |
| 0.4% Alon-C +0.15% $Ca(NO_3)_2$ +0.5% $NH_4NO_3$ | 2751 | 2664 | 87 | 96.8 |
| 1.0% Alon-C (Test #2) | 2721 | 2591 | 130 | 95.2 |
| 0.4% Alon-C +0.25% $Ca(NO_3)_2$ | 2756 | 2708 | 48 | 98.3 |

TABLE I-continued

Light Output With Various Phosphor-Coating Compositions

| Additive(s) in Phosphor Paint(% By Wt.) | Lumens 0 Hr. | Lumens 100 Hr | 0-100 Hrs. Lumen Drop | 0-100 Hrs. % Maintenance |
|---|---|---|---|---|
| +0.5% $NH_4NO_3$ | | | | |
| 1.0% Alon-C (Test #3) | 2812 | 2633 | 179 | 93.6 |
| 0.8% Alon-C +0.15% $Ca(NO_3)_2$ +0.5% $NH_4NO_3$ | 2791 | 2649 | 142 | 94.9 |
| 0.6% Alon-C +0.15% $Ca(NO_3)_2$ +0.5% $NH_4NO_3$ | 2805 | 2698 | 107 | 96.2 |
| 0.4% Alon-C +0.15% $Ca(NO_3)_2$ +0.5% $NH_4NO_3$ | 2809 | 2714 | 85 | 96.6 |
| 0.4% Alon-C +0.25% $Ca(NO_3)_2$ +0.5% $NH_4NO_3$ | 2793 | 2701 | 92 | 96.7 |

SPECIFIC EXAMPLE OF PHOSPHOR-COATING COMPOSITION

A specific example of the various steps in preparing a typical water-base phosphor-coating composition follows.

The nitrate additives are first prepared by dissolving 7.5 grams of $Ca(NO_3)_2.4H_2O$ in 100 ml of distilled water and dissolving 15 grams of $NH_4NO_3$ in another 100 ml of distilled water. The paint-dispersible phosphor suspension is then made by mixing 300 grams of a suitable phosphor (such as a well-known calcium halophosphate type phosphor) with 350 cc (5% by weight based on the phosphor) of a suitable organic binder (or lacquer) such as hydroxyethylcellulose, together with 20 drops of a suitable wetting agent such as alkylphenoxy ethanol (commercially available under the trademark "IGEPAL CO-610" from General Aniline and Film Corporation). Up to 10% by weight of the organic binder can be employed. The materials are then stirred for 20 minutes or so to provide a uniform mixture.

To the resulting mixture are then added 9 cc of the previously-prepared calcium nitrate solution (0.15% by weight $Ca(NO_3)_2$ based on the phosphor content) and 10 cc of the ammonium nitrate solution (0.5% by weight $NH_4NO_3$), along with 50 cc of the Alon-C suspension (6% by weight $Al_2O_3$), 5 cc of triethanolamine (which acts as a plasticizer) and 8 drops of a suitable defoaming agent such as an organic non-silicone (commercially available under the trademark "BALAB" from Witco Chemical Co.). The resulting aqueous phosphor-coating composition is then thoroughly mixed and applied in the usual fashion to the tin-oxide coated inner surface of the lamp bulb.

After the coated bulbs have been dried to remove most of the aqueous vehicle, they are lehred at a temperature of approximately 580° C. for around one minute or so to burn out the organic binder and provide the finished phosphor coating without impairing the conductivity or light-transmitting ability of the tin-oxide film.

Calcium nitrate has a melting point of 561° C. It accordingly provides good adhesion of the phosphor coating since it melts at a temperature that is considerably below the lehring temperature of 580° C. or so. Since the ammonium nitrate acts to reduce the melting temperature of the calcium nitrate, it further enhances the adhesion. Despite the fact that barium nitrate has a melting point of 592° C., it is also suitable for use in conjunction with the specified amounts of ammonium nitrate and $Al_2O_3$, particularly if the lehring temperature can be increased by 50° C. or so.

The calcium nitrate in the specific example can also be replaced by equivalent amounts of cadmium nitrate (melting point 350° C.) or strontium nitrate (melting point 570° C.).

It is also within the scope of the present invention to employ mixtures of the aforementioned metal nitrates in selected quantities within the specified ranges, either alone or in combination with ammonium nitrate, as additives in the improved phosphor-coating composition. For example, calcium nitrate and barium nitrate can be used together in small correlated amounts to form a "two-component" additive which has a melting point lower than either of the components if used separately and thus behaves somewhat like a eutectic. For example, it is known that a blend of $Ca(NO_3)_2$ and $Ba(NO_3)_2$ which contains from about 25 mole % to about 95 mole % $Ca(NO_3)_2$ melts at a temperature that ranges from 517° C. to about 550° C. From 0.05% to 0.25% by weight of such a blend of these two materials can thus be used as a two-component additive along with the Alon-C in the water-base phosphor-coating composition (without any of the ammonium nitrate additive) to provide an adherent phosphor layer on the tin-oxide coated fluorescent lamp bulbs, even through the latter are lehred at temperatures of around 580° C. to preserve the conductivity characteristics of the tin oxide film. A blend containing around 65 mole % $Ca(NO_3)_2$ melts at a temperature of about 517° C. and is thus preferred.

In like manner, a blend of $Ca(NO_3)_2$ and $Sr(NO_3)_2$ which contains from about 75 mole % to about 95 mole % $Ca(NO_3)_2$ melts in the range of around 540° C. to 550° C. and can be used in the phosphor paint along with the Alon-C.

If lehring temperatures of 600° C. or above can be tolerated, then a selected amount of Alon-C in combination with a blend of $Ba(NO_3)_2$ and $Sr(NO_3)_2$ which contains from about 20 mole % to about 80 mole % $Ba(NO_3)_2$ can be used in the phosphor-paint since such blends melt in the range of 585° C. to about 595° C. The preferred blend contains around 50 mole % $Ba(NO_3)_2$ and melts at about 585° C.

The peculiar "eutectic like" characteristics of the aforesaid $Ba(NO_3)_2$—$Ca(NO_3)_2$, $Ca(NO_3)_2$—$SrNO_3)_2$ and $Ba(NO_3)_2$—$Sr(NO_3)_2$ systems are disclosed in FIGS. 1060-1062 of the handbook entitled "Phase Diagrams for Ceramists" by E. M. Levin, C. R. Robins and H. F. McMurdie, published by the American Ceramic Society, 1964.

In view of the low melting points exhibited by the aforesaid two-component "eutectic like" blends of calcium, barium and strontium nitrates, such blends can also be used (in combination with selected small amounts of Alon-C) as additives in phosphor-paint compositions employed to coat conventional type fluorescent lamps (that is, those which do not have bulbs with transparent conductive films or a mixed starting gas so that they operate at reduced wattage).

While the invention has been described in terms of a fluorescent lamp having a tubular envelope whose entire surface has been coated with a transparent conductive film and then a phosphor layer, it is not limited to this type of lamp structure but includes within its scope such lamps as aperture-type fluorescent lamps wherein a longitudinal segment of the envelope is not coated with phosphor to thus serve as a "clear window".

I claim:

1. In the manufacture of a fluorescent lamp having a glass envelope that is interiorly coated with a transparent film of tin oxide, the method of depositing an adherent layer of phosphor on the tin-oxide coated surface of the lamp envelope, which method comprises;

preparing an aqueous suspension of phosphor particles containing, by weight based on the amount of phosphor, from about 0.05% to 0.25% calcium nitrate, from about 0.1% to 0.6% by weight finely-divided aluminum oxide, from about 0.1% to 0.8% ammonium nitrate, and a small amount of an organic binder up to about 10%, coating the inner surface of the lamp envelope with a layer of the aqueous phosphor-containing suspension, allowing the coated envelope to dry sufficiently to set the phosphor-containing layer in place, and then lehring the coated envelope at a temperature and for a time sufficient to melt the calcium nitrate and ammonium nitrate additives and concurrently burn out the organic binder and thereby produce an adherent layer of phosphor particles on the tin-oxide coated surface of the lamp envelope.

2. The method of claim 1 wherein the aqueous suspension of phosphor particles contains from about 0.15% to 0.25% calcium nitrate.

3. A fluorescent lamp having a vitreous envelope with a transparent film of conductive material on its inner surface which is substantially covered by an adherent layer of phosphor particles that has been deposited by the method comprising;

preparing an aqueous phosphor-coating composition that contains suspended phosphor particles, from about 0.1 to 0.6 weight % finely-divided aluminum oxide, from about 0.1 to 0.8 weight % ammonium nitrate and from about 0.05 to 0.25 weight % of another additive selected from the group consisting of calcium nitrate, barium nitrate, strontium nitrate and cadmium nitrate, the specified amounts being based on the phosphor weight, depositing a layer of the phosphor-coating composition on the inner surface of the envelope, drying the coated envelope to remove the major portion of the water from the deposited phosphor-coating composition, and then lehring the coated envelope at a temperature sufficient to melt all of the nitrate additives and bond the phosphor particles to the film-coated surface of the envelope.

4. The fluorescent lamp of claim 3 wherein;

the transparent conductive film on the inner surface of the lamp envelope is tin oxide, the conductivity whereof decreases at lehring temperatures in excess of about 580° C., the additives in the phosphor-coating composition consist essentially of from about 0.4% to 0.6% finely-divided aluminum oxide, from about 0.3% to 0.6% ammonium nitrate and from about 0.15% to 0.25% calcium nitrate, and the coated envelope is lehred at a temperature no greater than about 580° C.

5. A water-base phosphor-coating composition adapted for use in depositing an adherent layer of phosphor on the inner surface of a fluorescent lamp envelope which has previously been provided with a transparent film of conductive material, said phosphor-coating composition containing, by weight based on the phosphor content, from about 0.1% to 0.6% finely divided aluminum oxide, from about 0.1% to 0.8% ammonium nitrate, and from about 0.05% to 0.25% of another additive from the group consisting of barium nitrate, calcium nitrate, strontium nitrate, cadmium nitrate and mixtures thereof.

6. The water-base phosphor-coating composition of claim 5 wherein up to about 10% by weight of an organic binder material is also included in the composition.

7. In the manufacture of an electric discharge lamp having a vitreous envelope the inner surface whereof is provided with a thin light-transmitting film of conductive material which serves as a starting aid for the finished lamp and is, in turn, coated with a layer of phosphor material that is applied in the form of a liquid phosphor-coating composition that is subsequently lehred at a predetermined temperature which does not exceed the temperature that would deleteriously affect the conductive film, the improvement comprising the step of adding to the phosphor-coating composition, prior to the phosphor-coating operation, (a) from about 0.05% to 0.25% by weight of a material from the group consisting of calcium nitrate, cadmium nitrate, strontium nitrate, barium nitrate and mixtures thereof, (b) from about 0.1% to 0.6% by weight aluminum oxide in finely divided form, and (c) from about 0.1% to 0.8% by weight ammonium nitrate, the specified quantities of said additives being based on the phosphor content of the phosphor-coating composition and the amounts of the respective additives included in the coating composition being so correlated that the adhesion of the lehred layer of phosphor material is enhanced without substantially impairing the light output of the finished lamp.

8. The method of claim 1 wherein the phosphor-coating composition comprises a water-base composition and the nitrate additives are added to the composition in the form of aqueous solutions.

9. The method of claim 7 wherein;

said electric discharge lamp comprises a fluorescent lamp, the light-transmitting film of conductive material on the inner surface of the vitreous envelope comprises a transparent layer of tin oxide, and the phosphor-coating composition comprises an aqueous suspension of phosphor particles that contains from about 0.05 to 0.25 weight % calcium nitrate in combination with said correlated amounts of aluminum oxide and ammonium nitrate.

10. In the manufacture of an electric discharge lamp having a vitreous envelope, the method of coating the inner surface of the envelope with a layer of phosphor material, which method comprises;

preparing an aqueous suspension of phosphor particles containing from about 0.1% to 0.6% by weight $Al_2O_3$, up to about 10% by weight of an organic binder and from about 0.05% to 0.25% by weight of a phosphor-adhesion-promoting additive selected from the group consisting of (a) a blend of $Ca(NO_3)_2$ and $Ba(NO_3)_2$ which melts at a temperature in the range of from about 517° C. to about 550° C., (b) a blend of $Ca(NO_3)_2$ and $Sr(NO_3)_2$ which melts at a temperature in the range of from about 540° C. to about 550° C., and (c) a blend of $Ba(NO_3)_2$ and $Sr(NO_3)_2$ which melts at a temperature in the range of from about 585° C. to about 595° C., the specified weight percentages being based on the phosphor content of the aqueous suspension, coating the inner surface of the lamp envelope with a layer of the aqueous phosphor-containing suspension, allowing the coated envelope to dry sufficiently to set the phosphor-containing layer in place, and then lehring the coated envelope at a temperature above the melting point of the adhesion-promoting two-component additive for a time sufficient to melt said additive and concurrently burn out the organic binder and thereby produce an adherent layer of phosphor on the inner surface of the envelope.

11. The method of claim 10 wherein;

said $Ca(NO_3)_2$—$Ba(NO_3)_2$ blend contains from about 25 mole % to about 95 mole % $Ca(NO_3)_2$, said $Ca(NO_3)_2$—$Sr(NO_3)_2$ blend contains from about 75 mole % to about 95 mole % $Ca(NO_3)_2$, and said $Ba(NO_3)_2$—$Sr(NO_3)_2$ blend contains from about 20 mole % to about 80 mole % $Ba(NO_3)_2$.

12. The method of claim 10 wherein;

the inner surface of the vitreous envelope carries a thin light-transmitting film of conductive material that is located beneath the lehred layer of phosphor, and the aqueous phosphor-containing suspension also contains a predetermined correlated amount of $NH_4NO_3$.

13. The method of claim 12 wherein;

said light-tramsmitting conductive film comprises a transparent coating of $SnO_2$, and the adhesion-promoting additive consists of said $Ca(NO_3)_2$—$Ba(NO_3)_2$ blend or said $Ca(NO_3)_2$—$Sr(NO_3)_2$ blend.

14. An electric discharge lamp produced by the method of claim 10, 11, 12 or 13.

* * * * *